US006246328B1

(12) United States Patent
Parkinson et al.

(10) Patent No.: US 6,246,328 B1
(45) Date of Patent: Jun. 12, 2001

(54) EXTENDED RANGE PASSIVE MARKER

(76) Inventors: Timothy A. Parkinson; Ziyad H. Doany, both of P.O. Box 33427, St. Paul, MN (US) 55133-3427

( * ) Notice: Subject to any disclaimer, the term of this patent is extended or adjusted under 35 U.S.C. 154(b) by 0 days.

(21) Appl. No.: 09/571,183

(22) Filed: May 16, 2000

(51) Int. Cl.[7] ..... G08B 13/14

(52) U.S. Cl. ..... 340/572.1; 340/572.2; 340/572.4; 340/572.5; 340/572.7; 340/572.8

(58) Field of Search ..... 340/572, 572.1, 340/572.2, 572.4, 572.7, 572.8, 572.5

(56) References Cited

U.S. PATENT DOCUMENTS 4,712,094 * 12/1987 Bolson, Sr. ..... 340/572
4,761,656 * 8/1988 Cosman et al. ..... 340/571
5,045,368 * 9/1991 Cosman et al. ..... 428/34.1
5,699,048 * 12/1997 Galloway ..... 340/572
6,049,279 * 1/1999 Minarovic ..... 340/572.8

* cited by examiner

*Primary Examiner*—Jeffery Hofsass
*Assistant Examiner*—Hung Nguyen

(57) ABSTRACT

An extended range coil for an inductance-capacitance tuned circuit and a method for its manufacture. The extended range coil comprises a wire-wound planar spiral portion, having a circumference, and a wire-wound wall portion joined to the wire-wound planar spiral portion and extending outward from the circumference thereof. An extended range coil according to the present invention may use a continuous length of wire for winding the wire-wound planar spiral portion and the wire-wound wall portion.

8 Claims, 4 Drawing Sheets

EXTENDED RANGE PASSIVE MARKER

FIELD OF THE INVENTION

The present invention relates to passive markers buried with underground utilities such as gas, telephone, water and power lines. Appropriate placement of passive markers facilitates subsequent re-entry for line inspection. More particularly the invention relates to the shapes of coils used in inductance-capacitance tuned circuits to expand the detectable range wherein a locating device will intercept a resonant signal denoting a buried marker's position.

BACKGROUND OF THE INVENTION

Electronic marker devices, of the type having an inductance-capacitance tuned circuit, are known. Such devices comprise an air-core inductance provided by a wire coil connected in parallel with a capacitor. Optimum operation for relocation of such a marker requires vertical orientation of the longitudinal axis of the coil. A core-wound coil, also herein referred to as a solenoid coil, may be replaced in the tuned circuit by a substantially planar coil extending horizontally outward from a central axis. In this case, positioning of the marker beside a utility line preferably sets the coil in a horizontal plane with its central axis in vertical orientation. U.S. Pat. No. 4,712,094 provides a solution to earlier problems in achieving desired coil positioning using a marking device containing a floating tuned circuit that adopts the correct orientation regardless of initial placement of the marker beside a buried line.

Optimum orientation is important for coupling the coil of a passive marker with the coil of a locator device during relocating of a buried marker. Any difficulty associated with relocating a marker will complicate the process of reentry for maintenance or repair of a particular portion of the line. A locator of passive electronic markers normally emits a pulsed electromagnetic field to energize the marker. Between pulses, the marker releases its stored energy, at its resonant frequency, producing its own electromagnetic field. The resonant signal from the marker may be detected by switching the locator from transmitting mode to receiving mode. In the receiving mode, the maximum detectable signal usually identifies the position of a selected marker which lies adjacent to the portion of the utility line or line component requiring inspection. As previously discussed, tuned circuits floating inside a container adopt an orientation for optimum coupling of electromagnetic fields produced by the locator circuit and the marker tuned circuit. U.S. Pat. No. 5,699,048 describes effective coupling of signals using an orthogonal arrangement of plural tuned circuits. This tuned circuit arrangement produces a multidirectional response pattern that is more rapidly detected than that of poorly orientated single circuits.

Rapid, successful detection of the location of a marker reduces the amount of time for line inspection. The distance between a marker locator and a passive electronic marker will affect how quickly the position of the marker may be correctly identified. Successful marker detection depends upon the sensitivity of the marker locator and the range of detectable signal associated with the marker's resonating tuned circuit. Improvement in the range of a detectable signal will add further value to passive, essentially self-orienting marker devices.

SUMMARY OF THE INVENTION

The present invention provides a new coil design, also referred to herein as shape or form factor, for use in electronic markers that will increase the detectable range for a given package size by increasing the resonant circuit's quality (Q) factor. Prior efforts to increase a coil's detectable range involved adding turns of wire to increase the size of a coil, using e.g. ferrites, special wire and sectionalized bobbins and various combinations thereof. A coil using the novel form factor according to the present invention achieves increased Q factor and detectable range without the use of ferrites, special wire or sectionalized bobbins. Further improvement may be realized using ferrites and related materials or components but such use is optional. The form factor or shape for increased Q may be developed using a coil winding method that is also part of the present invention. The winding process occurs at high speed and reduced manufacturing cost.

Passive electronic marker devices according to the present invention provide self-orienting resonators having a greater detectable range to enable rapid identification and positioning of a selected buried marker. Self-orientation uses a floating tuned circuit as described in U.S. Pat. No. 4,712,094. This patent is commonly owned with the present application. The increase in detectable range, of markers according to the present invention, relates to modification of the form factor or shape of a coil element included in the tuned circuit with the capacitor.

A passive electronic marker according to the present invention includes an inductance-capacitance tuned circuit sealed inside a buoyant carrier. The carrier, in the form of a hollow disk, floats in a liquid that partially fills a hollow sphere. Size requirements for the hollow sphere control its internal volume and limit the space for the carrier and the tuned circuit it contains.

Increase in the detectable range of the tuned circuit may occur with an increase in coil size. Such an increase in the size of conventional coils, of either spiral wound or solenoid type, depends on the previously discussed space limitations affecting the size and internal space of the floating carrier. It is difficult, within the confined space of the hollow carrier, to increase the height of a typical solenoid coil or the horizontal dimension of a conventional spiral coil.

Tuned circuits according to the present invention provide improvement in their range of detection without change in the internal vertical or horizontal axes inside the hollow carrier. Improvement of detectable range occurs by forming an orthogonal radial wall at the outer edge of a spiral coil. The resulting coiled structure is dish-shaped with a diameter no larger than the diameter of the carrier and a wall height no higher than the height available inside the carrier. With optimal orientation, a coil of this type includes a spiral coil disposed horizontally, representing the base of the dish. The vertically extending radial wall has a radius substantially equal to the radius of the spiral coil. Formation of a radial wall extension on a spiral coil provides the benefits of an increased number of turns of wire while maintaining the size of the hollow carrier. The novel shaped coil has a better relative range than either a solenoid coil or a planar spiral coil. A passive electronic marker exhibiting a detectable range increase and automatic leveling reduces the time associated with installing and inspecting a utility line. Automatic leveling facilitates installation because the marker adjusts to a desired position even though dropped into a utility trench without thought for its orientation. An extended detectable range provides added value by reducing the time needed to locate a marker and inspect a portion of a utility line.

More specifically the present invention provides an extended range coil for an inductance-capacitance tuned circuit of a passive marker. The extended range coil comprises a wire-wound planar spiral coil, having a circumference, and a wire-wound wall joined to the wire-wound planar spiral coil and extending outward from the circumference thereof. An extended range coil according to the present invention may use a continuous length of wire for winding the wire-wound planar coil and the wire-wound wall.

The invention also includes a passive marker comprising an inductance-capacitance tuned circuit wherein the inductance has an extended range coil including a wire-wound planar spiral portion, having a circumference, and a wire-wound wall portion joined to the wire-wound planar spiral portion and extending outward from the circumference thereof. A hollow sphere partially filled with a liquid provides the container for a buoyant carrier carrying the tuned circuit and floating freely in the liquid for positioning the central axis of the coil closer to the vertical than the horizontal when the buoyant carrier is floating freely in the liquid.

The invention further includes a method for forming an extended range coil for an inductance-capacitance tuned circuit of a passive marker, comprising the steps of providing a mandrel assembly including a coil former having a back-plate, a faceplate, a notch and a circular spacer plate; and a wire support disk including a front surface in contact with the circular spacer plate, there being a gap formed between said faceplate and said front surface; feeding wire through an wire guide for clamping of the wire in a wire retention post attached to the wire former, with the wire guide aligned with the gap; rotating the mandrel assembly to draw the wire into the gap to coil the wire around the circular spacer plate to form a planar spiral portion until the diameter of the planar spiral portion begins to exceed the diameter of the faceplate; initiating movement of the wire guide towards the back-plate to form a wire-wound wall portion extending a distance between the faceplate and the backplate; separating the coil former from the wire support; and removing the extended range coil from the coil former.

BRIEF DESCRIPTION OF THE DRAWINGS

The invention presented herein will be further understood by reference to the accompanying drawings wherein.

DETAILED DESCRIPTION OF THE INVENTION

Buried features of utility lines may be located if they lie in close proximity to an electronic marker co-installed with a line feature. Electronic markers may be placed beside valves, cable splices, junctions and the like. The markers facilitate re-entry to hidden utility line features that became obscured from view by earth and aggregate fill materials used to close the trench dug during installation of the utility. Once buried, an electronic marker's position may be detected using a locator device that transmits a pulsed electromagnetic field to energize a resonant coil in the marker. The resonant coil is part of an inductance/capacitance circuit that is tuned to a specific frequency. Between pulses, from a nearby locator device, the marker emits energy, at its resonant frequency. The release of energy produces an electromagnetic field which the locating device receives, amplifies, filters and converts to an audible or visual signal which reaches a peak when there is least separation between the marker and the locator device.

Figure 1:
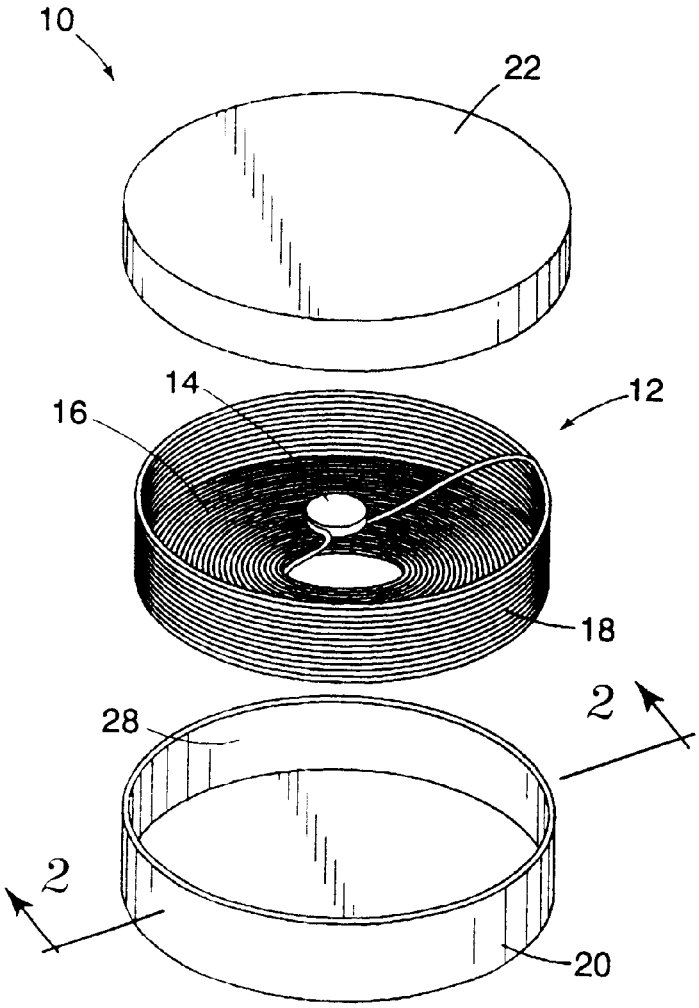
FIG. 1 is an exploded perspective view showing an inductance/capacitance tuned circuit that includes a capacitor and coil according to the present invention.

Referring now to the drawings, wherein like numerals identify like parts throughout the several views, FIG. 1 provides an exploded perspective view of a tuned circuit assembly according to the present invention including a coil 12 and a capacitor 14. The coil includes a planar spiral 16 and an outer wall 18. A two-part container for the coil comprises a carrier base 20 and a carrier cover 22. These parts 20,22 are preferably constructed from a thermoplastic material.

An assembly according to the present invention places the tuned circuit of the coil 12 and capacitor 14 inside the carrier base 20. After placing the carrier cover 22 over the carrier base 20, the assembly may be sealed by bonding the carrier cover 22 to the carrier base 20. Suitable methods for bonding the carrier cover 22 to the carrier base 20 include sonic welding, adhesive bonding and other well known methods for producing hermetic seals between components.

Figure 2:
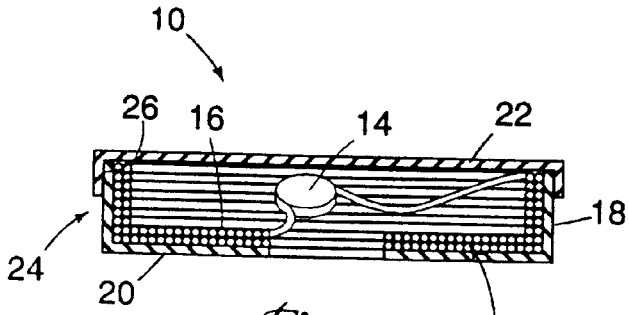
FIG. 2 is a section view taken along line 2—2 of FIG. 1.

FIG. 2 shows a cross section of the tuned circuit assembly 10 taken through line 2—2 of FIG. 1. In this representation a carrier 24 for the tuned circuit includes the carrier base 20 and the carrier cover 22. The carrier cover 22 overlaps the carrier base such that a seal 26 may be made between the outer sidewall of the carrier base 20 and the inner sidewall of the carrier cover 22. Materials for the carrier 22 can be any of a number of plastics, preferably thermoplastic materials including polyvinylchloride, polyethylene or acrylonitrile-butadiene-styrene. Different designs of the carrier 24 may be used for containment of the tuned circuit without forming an overlapped seal. It is important for the carrier to be hermetically sealed to prevent liquid seepage into the tuned circuit assembly when the carrier 24 floats in a liquid-containing marker. As shown in FIG. 2, a coil 12 according to the present invention may comprise multiple layers of wire.

Rapid marker detection, and more particularly successful marker detection, saves time for a field service agent and money for the utility company. The performance and value of an electronic marker increases with improvement in its detectable range relative to a given locating device. Detectable range may be expanded, to allow marker detection at greater distances, by improving the energy coupling between the marker's coil 12 and the transmit/receive coil of the locating device. The Q factor for an energy storing system also affects detectable range. An increase in the value of Q favors electronic marker detection at greater distances. Since Q is proportional to coil inductance the addition of turns to a coil 12 should raise the value of Q. Such addition of turns may be possible with the conventional coils represented by prior art coils of FIG. 3 and FIG. 4.

Figure 3:
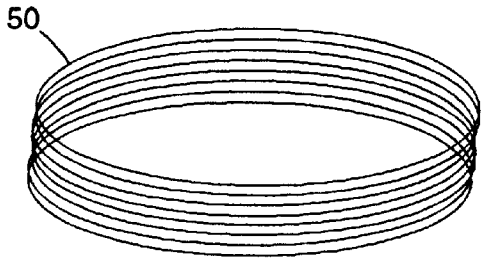
FIG. 3 provides a perspective view of a prior art coil construction

FIG. 3 shows a known coil 50 wound as a helical form factor coil, also known as a solenoid coil. Solenoid coils offer optimum coupling to the transmit/receive coil of a locating device. Adding turns of wire to increase the height of a solenoid coil results in an increase in Q factor. The hollow carrier used in the present invention has an internal height of about 1.25 cm. This height requirement limits the winding of a single-layer solenoid coil to only 34 of turns of 28AWG copper magnet wire as shown in Table 1.

Figure 4:
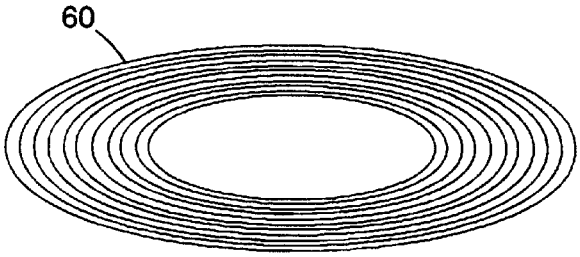
FIG. 4 shows perspective view of an alternative prior art coil construction

FIG. 4 shows a previously known planar spiral coil 60 produced by wrapping turns of wire of increasing radius in a common plane. Since the carrier of the present invention has an internal diameter of about 8.9 cm, a spiral coil may include about 141 turns of 28AWG copper magnet wire. As a result the spiral coil has a Q factor almost twice that of the solenoid coil. However, the spiral coil couples less than a solenoid coil with the transmit/receive coil of a locating device. The detectable range of the spiral coil tuned circuit nevertheless exceeds that of the solenoid coil.

FIG. 1 shows a coil 12 including a planar spiral 16 joined to an orthogonal wire-wound wall 18 that extends from the circumference of the planar spiral 16. After installation in a passive marker, the extending wall 18 lies substantially parallel to the internal sidewall 28 of the hollow, disk-shaped carrier 24 (see FIG. 2). The height of the extending wall 18 approximates the height of the cavity formed within the hollow carrier 24. Addition of the orthogonal, wire-wound wall 18 to a planar spiral 16 produces a dish-shaped coil 12 with more turns of wire than previously contemplated, considering space limitations inside the hollow carrier 24. This shape or form factor of the coil 12 is responsible for the increased detectable range of tuned circuits used in passive markers according to the present invention. In comparison with the form factors of previously used coils 50, 60 , shown in Table 1, a dish shaped coil 12 provides a detectable range gain of between 8% and 15% relative to a common locator device.

TABLE 1

Detectable Range Comparison for Coils of Differing Form Factor

| Coil Type | Turns | I.D. cm | O.D. cm | Width cm | $k_{coupling}$ | Q 100 KHz | Relative Detectable Range |
|---|---|---|---|---|---|---|---|
| Solenoid | 34 | 8.9 | 9.0 | 1.25 | $4.01 \times 10^{-05}$ | 57.6 | 100% |
| Spiral | 141 | 4.32 | 9.0 | 0.09 | $3.27 \times 10^{-05}$ | 91.3 | 107% |
| Invention | 175 | 4.32 | 9.0 | 1.25 | $3.61 \times 10^{-05}$ | 108.1 | 115% |

Note:
1. All coils are wound with 28 AWG copper magnet wire.
2. Q is evaluated at 100 KHz.
3. Dimensions are equal where applicable.

Passive markers for use with buried utilities preferably use novel dish-shaped coils 12 in tuned circuit assemblies 10 according to the present invention. A tuned circuit resides inside a sealed, disk-shaped carrier 24 that floats inside a spherical container that denotes the size of a ball-shaped passive marker.

Figure 5:
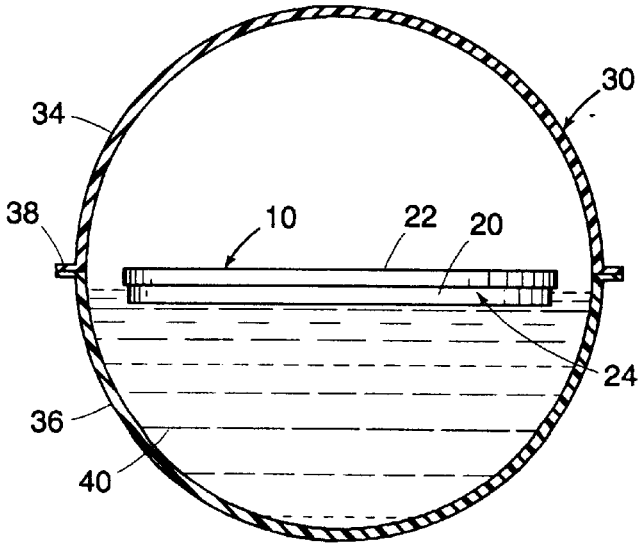
FIG. 5 is a section view of a passive marker according to the present invention showing a free floating tuned circuit assembly positioned within a spherical housing.

FIG. 5 provides a cross-sectional view of a ball-shaped passive marker 30. The marker combines the benefits of an increased detectable range and self-orientation of the tuned circuit assembly 10 after dropping the marker 30 into a utility installation trench. Further detail of the brief description of a self-orientating tuned circuit, presented herein, may be found in U.S. Pat. No. 4,712,094 which patent is commonly owned with the present application. The tuned circuit resides enclosed in the hollow carrier 24 inside the spherical housing, including an upper hemisphere 34 and a lower hemisphere 36, of the ball-shaped marker 30. The spherical housing may be formed from a suitable plastic such as high density polyethylene. The hemispheres 34, 36 optionally have a small outwardly extending flange 38 to provide a surface at which the two hemispheres 34, 36 can be fused by the use of ultrasonic vibration or spin welding or related techniques. After the carrier 24 has been positioned within the spherical housing and the hemispheres 34 and 36 have been fused together, a measured quantity of liquid 40 is introduced into the ball-shaped marker 30 via a hole (not shown) which is closed after the liquid 40 is introduced. The liquid 40, usually a glycol and water mixture, causes the hollow carrier 24 and tuned circuit to float freely within the spherical housing. The floating carrier 24 facilitates positioning of the tuned circuit assembly 10 in a preferred orientation for optimum coupling with a marker-locating device. A ball-shaped marker 30 having a floating tuned circuit assembly 10 sets the tuned circuit in the preferred orientation regardless of the placement of the ball-shaped passive ball marker 30 in a utility installation trench.

Figure 6:
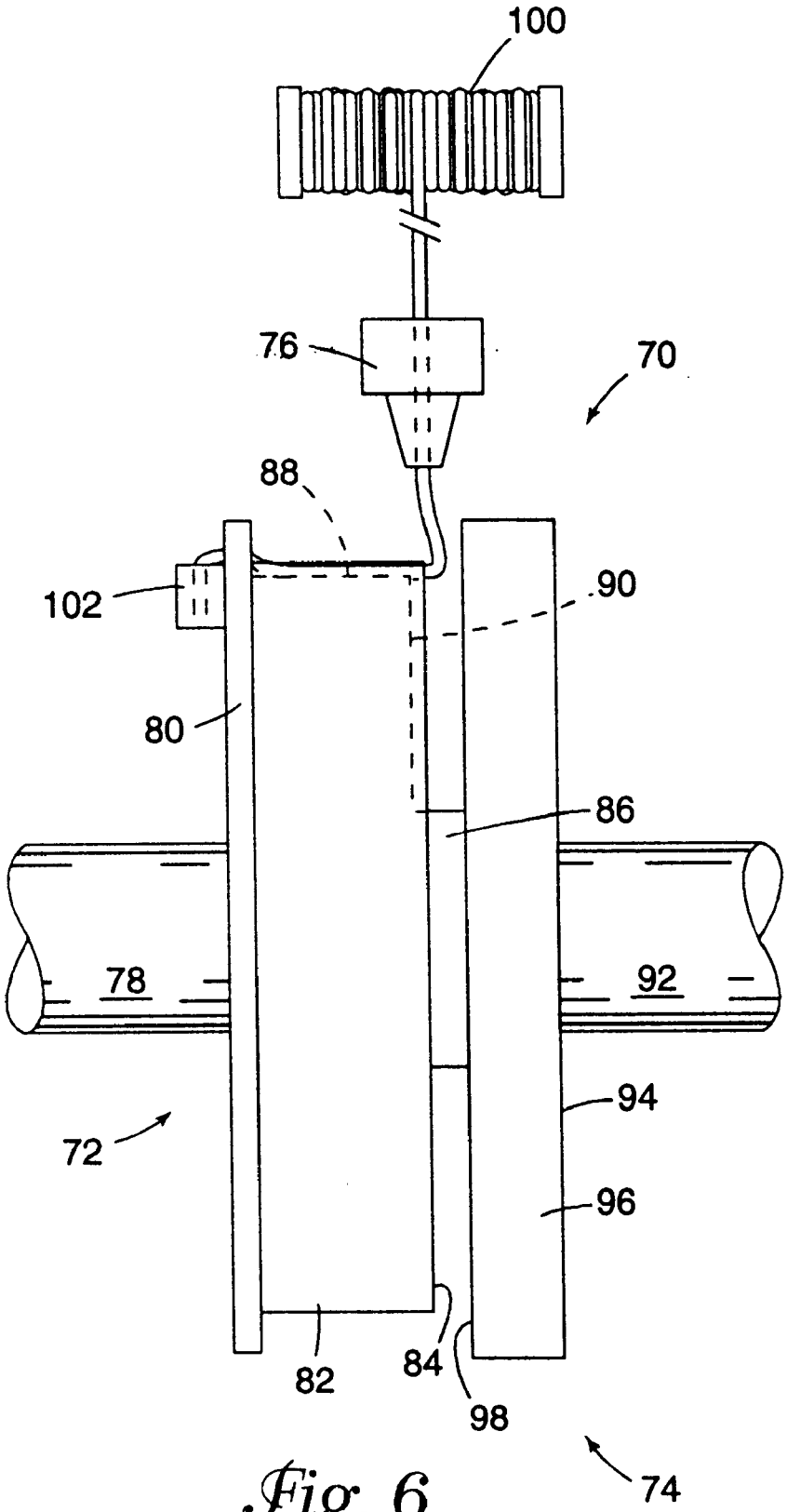
FIG. 6 is a side elevation of a mandrel assembly used in for the process of manufacturing a dish-shaped coil according to the present invention.
Figure 7:
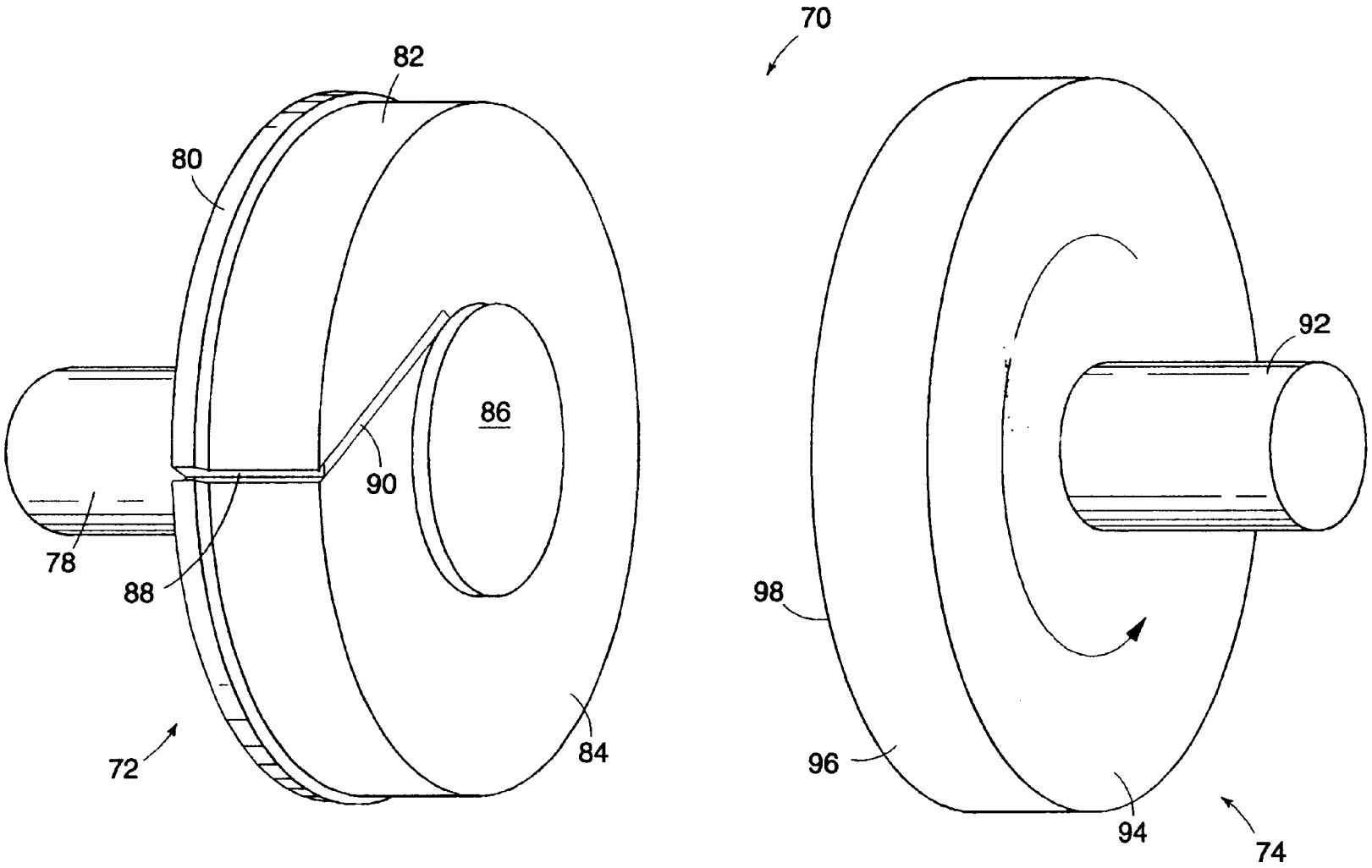
FIG. 7 provides an exploded perspective view of a mandrel assembly used in for the process of manufacturing a dish-shaped coil according to the present invention.

The present invention includes a method for making a dish shaped coil 12. FIG. 6 and FIG. 7 show a mandrel assembly 70 that includes a coil former 72, and a wire support disk 74. Wire is fed to the mandrel assembly 70 through a wire guide 76.

Structural features of the coil former 72 include an axle 78 connected to the back-plate 80 of a shallow cylinder 82. The shallow cylinder 82 has a faceplate opposite the back-plate 80. A circular spacer plate 86, coaxial with axle 78, covers a central area of the faceplate 84 and extends the thickness of the spacer plate 86 above the faceplate 84. There is a notch 88 between the back-plate 80 and faceplate 84 of the shallow cylinder 82 to provide temporary gripping surfaces for wire. The notch 88 connects to a groove 90 machined across the faceplate 84 to place the groove 90 and the edge of the circular spacer plate 86 in a substantially tangential relationship.

A wire support disk 74 of a mandrel assembly 70 according to the present invention comprises a shaft 92 centrally mounted on the rear surface 94 of a disk 96. The front surface 98 of the disk 96, opposite the rear surface 94, is a planar surface.

Correct positioning of parts of the mandrel assembly 70 requires placement of a coil former 72 and wire support disk 74 with coaxial alignment of the axle 78 and the shaft 92 and frictional contact between the circular spacer plate 86 and the front surface 98 of the wire support disk 74. Frictional contact between the coil former 72 and wire support disk 74 is important to generate co-rotation of these parts, around the coaxially aligned axle 78 and shaft 92, with rotational energy applied to only one of them. As an alternative, interlocking features may be placed at the surface of the circular spacer plate 86 and the front surface 98 of the wire support disk 74 for interlocking co-rotation while either the axle 78 or shaft 92 is driven, leaving the other to rotate freely. Rotation of the mandrel assembly may be clockwise or counter-clockwise depending upon the direction from which the groove 90 approaches the circular spacer plate 86. FIG. 7 indicates counter-rotation of the support disk with a tangential relationship between the top edge of the spacer plate 86 and the groove 90. Mandrel assembly 70 rotation would be clockwise if the groove 90 approached bottom edge of the circular spacer 86.

A supply of wire, preferably from a wire-filled bobbin 100, is fed through a wire-guide 76 for attachment to a wire retention post 102 located on the back plate 80 adjacent to the notch 88. After attachment to the wire retention post 102, and insertion of the wire in the notch 88, the mandrel assembly 70 may be rotated with the wire guide 76 positioned above the gap formed by the faceplate 84 of the wire former 72 and the front surface 98 of the wire support disk 74. As the mandrel assembly 70 rotates, the gripping action of the notch 88 on the wire causes the wire to follow the movement of the notch 88. Tangential positioning of the groove 90, relative to the circular spacer plate 86, contributes to the uniform application of turns of wire when the wire passes along the groove 90 during the coil winding process. This draws more wire from the wire supply bobbin 100 as the wire begins to coil around the circumference of the circular spacer plate 86 to form the spiral portion 16 of the dish-shaped coil 12. Coil formation begins with the central section of a spiral coil 16. The coil diameter gradually increases until coiled wire fills the gap between the faceplate 84 of the wire former 72 and the front surface 98 of the wire support disk 74. As the diameter of the spiral 16 begins to exceed the diameter of the faceplate 84 the wire guide 76 moves, under X-axis control, towards the back-plate 80 of the coil former 72, as the mandrel assembly 70 continues to rotate. As used herein, the term X-axis control refers to linear movement of the wire guide 76 in a horizontal plane above the mandrel assembly. The horizontal plane extends from the back-plate 80 to the gap formed by the faceplate 84 of the wire former 72 and the front surface 98 of the wire support disk 74. Motion of the wire guide 76 produces an orthogonal wire-wound wall 18 extending from the perimeter of the planar spiral coil 16. The height of the wall 18 depends upon distance selected for X-axis movement of the wire guide. When the wire-wound wall 18 is filly formed a terminal extension of the wire may be wrapped over the back-plate 80 or otherwise secured for future use to connect the coil to an electrical circuit, such as a tuned circuit. The dish-shaped coil 12, now supported on the coil former 72, may be separated from the wire supply bobbin 100 by severing the wire.

Preferably self-bonding magnet wire is the material used to form the dish-shaped coil 12. If this is the case, either heat or solvents may be used for bonding adjacent turns of wire together. The bonded structure becomes stable as a self-supporting dish-shaped coil 12 that retains its shape after separating the mandrel assembly 70 and removing the coil 12 from the coil former 72.

The circular spacer plate diameter 86 controls the internal diameter (I.D.) of the spiral portion 16 of the dish-shaped coil 12. Also the width of the spiral winding substantially matches the thickness of the circular spacer plate 86 that sets the gap between the faceplate 84 of the wire former 72 and the front surface 98 of the wire support disk 74. This spacer 86 is not necessarily integral with the faceplate 84. It may be detachable for replacement by spacer plates of differing dimensions. This provides flexibility as required to produce a variety of sizes of dish-shaped coils 12 according to the present invention.

Dish-shaped coils 12 may be wound using automated or semi-automated coil winding machinery. X-axis (left-right direction) control of the wire guide 76 relies upon cams or servo-motors. During winding of the spiral portion 16 of the coil 12, the X-axis control remains stationary, in a fixed location above the gap between the faceplate 84 of the wire former 72 and the front surface 98 of the wire support disk 74. The X-axis control operates during formation of the wire-wound wall 18 and may cause reciprocal movement of the wire guide 76 as needed to provide multiple layer wall sections. Under X-axis wire control, the wire guide 76 moves a distance approximating the thickness of a single wire for each revolution of the mandrel assembly 70. The dish shaped coil 12 may be made from two portions of coil produced as separate spiral coil 16 and wall sections 18 and then joined together physically, electrically and magnetically. Preferably, for reduced cost, the formation of such a structure uses a single continuous length of wire wound on a mandrel assembly 70, as previously described.

A dish shaped coil for extending the range of a passive marking device and a method of making the coil have been described according to the present invention. Those having skill in the art will appreciate that, in light of the present disclosure, changes may be made to embodiments disclosed herein without departing from the spirit and scope of the invention.

What is claimed is:

1. An extended range coil for an inductance-capacitance tuned circuit of a passive marker, said extended range coil comprising:

a wire-wound planar spiral coil having a circumference; and a wire-wound wall joined to said planar spiral coil and extending outward from said circumference thereof.

2. An extended range coil for an inductance-capacitance tuned circuit of a passive marker, said extended range coil comprising:

a wire-wound planar spiral portion having a circumference; and a wire-wound wall portion joined to said planar portion and extending outward from said circumference thereof.

3. An extended range coil according to claim 2 wherein said planar spiral portion and said wall portion are wound from a continuous length of wire.

4. A passive marker comprising:

an inductance-capacitance tuned circuit wherein said inductance has an extended range coil including a wire-wound planar spiral portion having a circumference; and a wire-wound wall portion joined to said wire-wound planar spiral portion and extending outward from said circumference thereof;

a hollow sphere partially filled with a liquid; and a buoyant carrier carrying said tuned circuit and floating freely in said liquid for positioning said axis of said coil closer to the vertical than the horizontal when said buoyant carrier is floating freely in said liquid.

5. A passive marker according to claim 3 wherein said tuned circuit is enclosed in said buoyant carrier.

6. A method for forming an extended range coil for an inductance-capacitance tuned circuit of a passive marker, comprising the steps of:

providing a mandrel assembly including a coil former having a back-plate, a faceplate, a notch and a circular spacer plate; and a wire support disk including a front surface in contact with said circular spacer plate, there being a gap formed between said faceplate and said front surface;

providing a wire guide to direct wire towards said mandrel assembly;

feeding wire from said wire guide for clamping of the wire to a wire retention post attached to said wire former, said wire guide aligned with said gap;

rotating said mandrel assembly to draw the wire into said gap to coil the wire around said circular spacer plate to form a planar spiral portion until the diameter of said planar spiral portion begins to exceed the diameter of said faceplate; and initiating movement of said wire guide towards said back-plate to form a wire-wound wall portion extending a distance between said faceplate and said back-plate.

7. A method for forming an extended range coil according to claim 6 further comprising the steps of separating said coil former from said wire support; and removing said extended range coil from said coil former.

8. A method for forming an extended range coil according to claim 6 wherein said wire guide is under X-axis control.

* * * * *

UNITED STATES PATENT AND TRADEMARK OFFICE

CERTIFICATE OF CORRECTION

PATENT NO. : 6,246,328 B1
DATED : June 12, 2001
INVENTOR(S) : Timothy Parkinson

It is certified that error appears in the above-identified patent and that said Letters Patent is hereby corrected as shown below:

Title page,
Item [76] Inventors should read as follows:
-- [76] Inventors: Timothy A. Parkinson; Ziyad H. Doany; Larry R. Cox, all of Austin, Texas --.

Signed and Sealed this

Nineteenth Day of March, 2002

*Attest:*

*Attesting Officer*

JAMES E. ROGAN
*Director of the United States Patent and Trademark Office*